United States Patent [19]

Fosher

[11] 4,155,477

[45] May 22, 1979

[54] STACKING TRAYS TOP ACCESSIBLE BY HORIZONTAL SWIVELING

[76] Inventor: Donald H. Fosher, P.O. Box 16667, Clayton, Mo. 63105

[21] Appl. No.: 939,286

[22] Filed: Sep. 5, 1978

[51] Int. Cl.[2] ..... B65D 21/02; A47B 87/02

[52] U.S. Cl. ..... 220/4 D; 312/201

[58] Field of Search ..... 220/4 C, 4 D, 23.6, 220/23.83, 23.86; 206/509, 511, 512, 503; 312/201, 202

[56] References Cited

U.S. PATENT DOCUMENTS

| | | | |
|---|---|---|---|
| 1,256,306 | 2/1918 | Glanton | 312/201 |
| 1,289,657 | 12/1918 | Cheney | 312/201 |
| 2,582,421 | 1/1952 | Essman | 312/201 |
| 3,161,315 | 12/1964 | Braun | 220/4 C |
| 3,188,157 | 6/1965 | Rand | 312/202 |
| 3,392,868 | 7/1968 | Pfrommer | 312/201 |

FOREIGN PATENT DOCUMENTS

| | | | |
|---|---|---|---|
| 101346 | 3/1965 | Denmark | 220/4 D |

*Primary Examiner*—George E. Lowrance

[57] ABSTRACT

Small trays may conveniently be used, in the packaging of items such as fishing lures, for re-use in containing such items and holding them securely and conveniently. For this purpose a stacking tray, used in combination with like stacking trays, has a molded plastic body having rhomboid-shaped parallel upper and lower sides forming opposite acute angle corners. The upper side has a plurality of integrally molded container-like portions and, at each acute angle corner, has upward-extending pivot pins. The lower side has, directly beneath one pivot pin, an upward-extending bore which snap-accepts a pivot pin to permit an overlying tray to rotate from above an underlying tray, and directly beneath the other pivot pin a track is formed in an arc about the bore to slideably accept a pivot pin, the track extending to open ends at the outer side of the body. The track has, beneath the pivot pin, a detent to latch underlying and overlying trays aligned in registration, forming a closed container.

6 Claims, 5 Drawing Figures

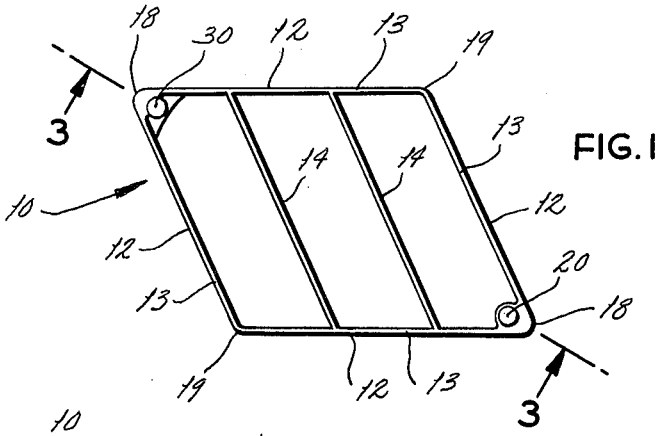
FIG. 1
FIG. 2
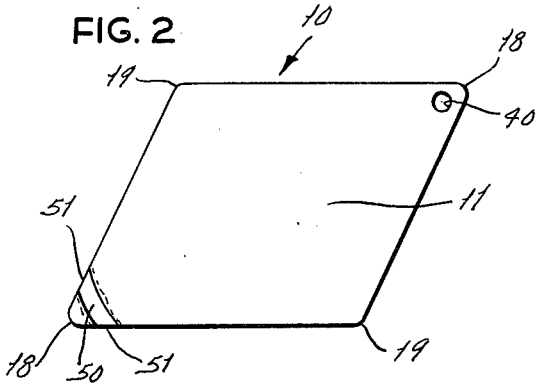
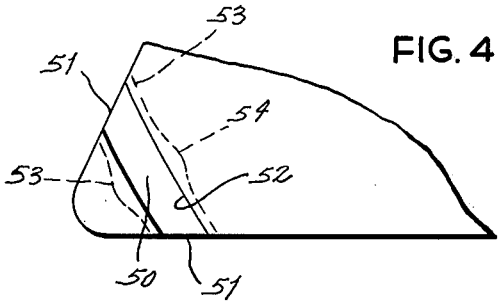
FIG. 4
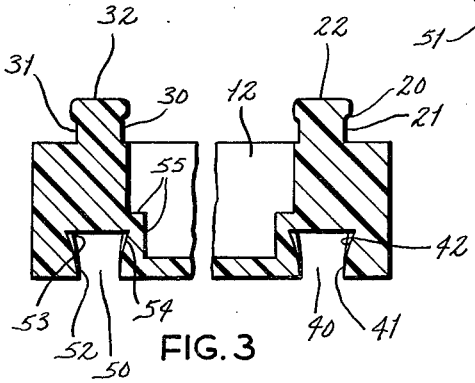
FIG. 3
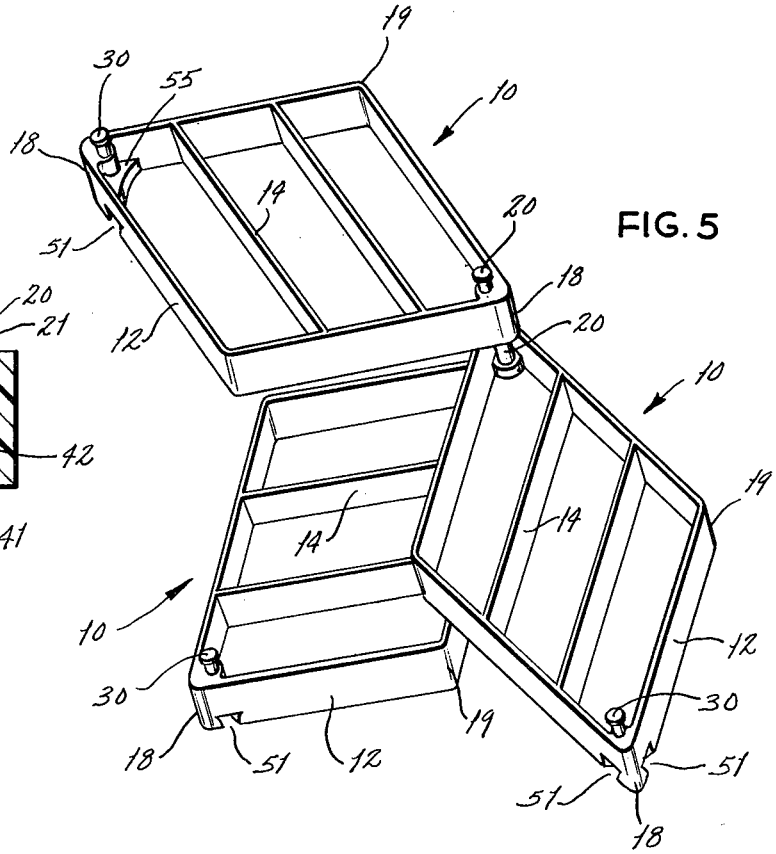
FIG. 5

STACKING TRAYS TOP ACCESSIBLE BY HORIZONTAL SWIVELING

BACKGROUND OF THE INVENTION

The present invention relates to container-like stacking trays which may be easily carried from place to place and in which easy access to underlying trays is available. It relates more particularly to trays capable of use singly in packaging small items for sale, and thereafter useful stacked together for convenient storage and handling of the sold items.

In the prior art, trays have commonly been so constructed to permit stacking when not in use. Stacking features also have been incorporated in storage trays, in which access to the interior of the tray is either from the top of the tray or through openings in the tray sides or ends. Top access is often prohibitively inconvenient; to gain an access to a tray, all overlying trays must be separated from and removed from above that tray. Side or end openings may be used only for trays which generally are kept in a fixed place since the material stored inside may fall out as the trays are moved.

Various constructions have been utilized to provide for stacking: ribs which fit into grooves, lugs which engage bores, and guides in the upper side of the tray which receive between them the sides of an overlying tray, as well as other more complex constructions.

SUMMARY OF THE INVENTION

An object of the present invention is to provide stacking trays in which top access to underlying trays is easily available. Another object is to provide top-accessible stacking trays which remain coupled to one another while access to an underlying tray is gained.

In the present invention, these objects are achieved by features which afford security of attachment in stacked alignment and also permit relative angular movement out of such alignment for easy top access to contents. Briefly summarizing, the present invention comprises a resilient molded plastic tray body having parallel rhomboid-shaped upper and lower sides. The body is enclosed and has inner partitions to define container compartments, but the upper side is open to provide access. Upward-extending pivot pins having enlarged heads are provided at the opposite acute angle corners of the upper side. In the lower side, a bore extends upward directly beneath one pivot pin, of such size as to accept a pivot pin of an underlying tray and ending upwardly in an enlarged head portion to snap-accept the enlarged head. Beneath the other pivot pin, the lower side has an arcuate track formed in an arc whose center is the bore means, which is of sufficient width to slidably accept a pivot pin which terminates in open ends at the outer side of the tray. The arcuate track has directly beneath the pivot pin an enlarged detent portion.

In use, a pivot pin of a tray is snapped into the bore of an overlying tray. The overlying tray may receive the other pivot pin in its arcuate track; when the pivot pin is detained in the enlarged detent portion the trays are aligned in overlying-underlying relationship. The overlying tray may be swiveled from above the underlying tray, its pivot pin passing through an open end of the arcuate tracks, whereby top access to the underlying tray is available. A plurality of such trays may be stacked together as desired; since the tray lower side is flat, the lowermost tray will support the stack of trays upright.

BRIEF DESCRIPTION OF THE DRAWINGS

FIG. 1 is a top view of a rhomboid-shaped stacking tray embodying the present invention.

FIG. 2 is a bottom view of the stacking tray of FIG. 1.

FIG. 3 is a section taken along line 3—3 of FIG. 1 showing the details of the pivot pins, bore and arcuate track.

FIG. 4 is an enlarged bottom view showing the details of the arcuate track.

FIG. 5 is an oblique view of three stacking trays swiveled so that top access is available to both underlying trays.

DESCRIPTION OF THE PREFERRED EMBODIMENT

In the preferred embodiment of the present invention, a stacking tray which, when assembled beneath a similar tray, is top accessible by horizontal swiveling, has a molded plastic tray body, generally designated 10, which is rhomboid-shaped when viewed from above and below, as seen in FIGS. 1 and 2. The lower side 11 of the body 10 is flat and rhomboid-shaped, as shown in FIG. 2. Vertical side walls 12 extend upward from along the four edges of the body lower side 11, ending upwardly in a rhomboid-shaped upper side edge 13, which is parallel to the lower side 11. The upper side of the body 10 is open; partitions 14 extend upward from the lower side to the level of the upper side edge 13, forming container-like depressions or compartments in the body 10 as shown in FIG. 1. The rhomboid-shaped body 10 has at the opposite junctions of its vertical side walls 12, acute angle corners 18 and oblique angle corners 19.

In one of the acute angle corners 18, the plastic body 10 has an integrally-molded first pivot pin 20 which extends substantially vertically upward above the body upper side edge 13. Above the upper side edge 13, the first pivot pin 20 has a shank portion 21 leading upwardly to and terminating in an enlarged head portion 2 of greater diameter than the shank portion 21, best shown in FIG. 3.

In the acute angle corner 18 opposite the first pivot pin 20, the body 10 has a second pivot pin 30, substantially identical to the first pivot pin 20. Above the body upper side edge 13, it has a shank portion 31 terminating upwardly with an enlarged head portion 33.

The body lower side 11 has a bore 40 extending substantially vertically upward directly beneath the first pivot pin 20, the bore length being equal to or greater than the extent of the first pivot pin 20 above the upper side edge 13. The lower portion 41 of the bore 40 has a diameter greater than the pivot pin shank portion 21, 31, but less than the diameter of the pivot pin enlarged head portion 22, 32. The upper portion 42 of the bore 40 is enlarged to accept the pivot pin enlarged head portion 22, 32, being slightly larger in diameter than the head portion 22, 32, best shown in FIG. 3.

The acute angle corner 18 on the lower side 11 opposite the bore 40 has an arcuate track 50, shown in FIG. 2, formed in an arc whose center is the center of the bore 40. The arc radius equals the separation between the two pivot pins 20, 30; thus, the track 50 lies directly beneath the second pivot pin 30. As shown in FIG. 4, the arcuate track 50 terminates outwardly in open ends 51 at the two outer vertical side walls 12 of the body 10 which forms the acute angle corner 18. The lower portion 52 of the track 50 is of sufficient width to slidably accept the shank portion 21, 31 of a pivot pin 20, 30, but its width is less than the pivot pin enlarged head portion 22, 32, as shown in FIG. 3. The width of the upper portion 53 of the arcuate track 50 is slightly greater than the width of the lower portion 52, but slightly less than the diameter of the pivot pin enlarged head portion 22, 32. Directly beneath the second pivot pin 30, the arcuate track 50 has an arcuately enlarged detent portion 54, at which point the track 50 is slightly greater in width than the diameter of the pivot pin head portion 22, 32, best seen in FIG. 4. Imperforate inner and upper separator wall portions 55 divide the track 50 from the interior of the tray 10, as shown in FIG. 3.

Manufacture of the above-described stacking trays may be performed by conventional plastic molding techniques. Chief attention must be directed toward tolerances for the pivot pins, bore and arcuate track to insure both secure interfit and ease of utilization of the stacking trays. Such tolerances vary according to the characteristics of the plastic utilized, mainly its elasticity.

The present invention may be utilized by assembling a plurality of the above-described trays in underlying-overlying relationship. For a fan-like stacking assembly, as shown in FIG. 5, the first pivot pin 20 of each underlying tray is snapped into the bore 40 of the tray above it; then any tray may be swiveled or rotated horizontally with respect to the others. When swiveled, as a tray is nearly vertically aligned with another, the second pivot pin 30 of the underlying tray engages slidably within the arcuate track 50 of the tray directly above it. Upon continued rotation, the trays become perfectly aligned; then the second pivot pin enlarged head portion 32 engages and is elastically detained in the arcuatlely enlarged detent portion 54 of the track 50. The resiliency of the plastic material permits the second pivot pin 30 with its head portion 32, by force applied to the body side walls 12, to be forced in either direction along the arcuate track 50 to disengage the stacked trays for horizontal swiveling to gain top access to underlying trays.

If desired, alternate methods of stacking may be used. For example, two trays may be stacked as described above, with a third tray engaged by its bore 40 into the second pivot pin 30 of either the underlying or the overlying tray, permitting the trays to be laid out in a chain-like fashion. If the third tray is mounted to the second pivot pin 30 of the overlying tray, the trays may again be swiveled for stacking in vertical alignment one above another.

The present invention is especially suited for safekeeping of small articles, such as fishing lures, sewing articles, etc. The trays, being quite inexpensive to manufacture, may be packaged for sale, with the lower side 11 against a perforated display card, the fishing lures or other articles to be sold being placed between the partitions 14 and the assembly covered by heat-formed plastic. Customers who have purchased several will find a stacked assembly of them particularly useful in organizing their tackle boxes. Since the arcuate track 50 has the imperforate inner and upper separator wall portions 55 dividing the track from the container-like depressions formed into the body upper side, and since the upper side edge 13 is parallel to the lower side 11 and the pins 20, 30 are short enough to hold the stacked trays firmly together, the stacked assembly of trays resists entry of water into the compartments. If the stacked assembly should fall overboard, it will remain afloat for a sufficient period for the fisherman to retrieve it. Flotation may be further facilitated by manufacturing the trays of a lightweight plastic.

The rhomboid shape of the body 10 will be seen to be particularly suitable, since the length and displacement of interior space of the arcuate track 50 may then be minimized by its placement in the actue angle corner 18. The entire compartment and upper side of an underlying tray may be exposed by rotation of the overlying tray angularly for a small angle due to placement of the pivot pin in the acute angle corner. Thus, top access to a large number of stacked trays may be had simultaneously. The rhomboid-shaped body 10 is effective as a fish scaler; it conforms to the fisherman's hand and the acute angle corners 18 aid in scaling around fins and gills.

The above-described stacking tray is the preferred embodiment of the present invention. Modifications will be apparent to persons skilled in the art. For example, for trays capable of only fan-like stacking, as shown in FIG. 5, the first and second pivot pins need not be identical; the first pivot pin and bore and the second pivot pin and the arcuate track must accommodate one another. In some circumstances, the track need not take on a precisely arcuate shape; where its length is short, it may be sightly V-shaped or even straight, relying on bending the pivot pin which engages the track. The track should continue to and terminate in at least one open end on the outer vertical side walls 12 of the body 10. Other pivot pin receiving means which extend upward into the body lower side beneath a pivot pin and which extend upward into the body lower side beneath the pivot pin and which will engage a pivot pin and permit pivoting thereabout may be utilized. The track may have any detent means, located directly beneath a pivot pin, to latch an underlying tray by its pivot pin in fixed position above the underlying tray. The tray body may take almost any shape, such as any type of parallelogram or other polygon, or an elipse or other closed curve; the upper and lower sides should be parallel. Other modifications, from this disclosure, will suggest themselves to persons skilled in the art.

I claim:

1. A stacking tray, for use in combination with one or more similar stacking trays stacked in underlying-overlying relationship, comprising a resilient molded plastic body having parallel upper and lower sides and having opposite corners, said body having one or more integrally molded container-like depressions in its said upper side, one of said corners having (a) first pin means extending substantially vertically upward from the body upper side and having a shank portion terminating in an enlarged head portion, and (b) bore means extending substantially vertically upward into its lower side directly beneath said first pin means and having an upper bore portion enlarged to accept the head portion of a said pin means, whereby to permit such overlying tray to rotate angularly about such first pin means from above such underlying tray;

the other said corner having (a) second pin means extending substantially vertically upward from the body upper side and having a shank portion terminating in an enlarged head portion, and (b) arcuate track means, formed in the lower side of said body and continuing to open ends at the outer side of said body, to slidably accept said second pin means of such underlying tray, said track means being formed in an arc whose center is said bore means and which has such radius as to lie directly beneath said second pin means, said arcuate track means being of a width sufficient to accept the shank portion of a said second pin means, the upper portion of said track being generally narrower than the width of the head portion of said second pin means and having intermediate its open ends and below said second pin means an arcuately enlarged detent portion, whereby the resiliency of the material permits the head portion of said second pin means to be forced in either direction along said arcuate track and to be elastically detained within said arcuately enlarged detent portion.

2. The stacking tray as defined in claim 1, wherein said first pin means and said second pin means are identical, whereby to permit reversed assembly, with said bore means receiving either said first pin means or said second pin means of an underlying tray.

3. The stacking tray as defined in claim 1, wherein said upper and lower sides of said body are of rhomboid shape, and wherein said opposite corners are the acute angles of said rhomboid, whereby to minimize the length and space requirements of the arcuate track and to minimize the angle of rotation required to expose an underlying tray.

4. A stacking tray, for use in combination with one or more similar stacking trays stacked in underlying-overlying relationship, comprising a resilient molded plastic body having parallel upper and lower sides and having one or more integrally molded container-like depressions in its upper side.

said body having first and second pin means extending upward from opposing ends of said body upper side, at least the first of said pin means being a pivot pin, and first and second pivot pin receiving means, extending upward into said body lower side beneath each said pivot pin means, to engage the first and second pin means of such underlying tray, at least the first of said receiving means being so conformed as to permit pivoting about the pivot pin of such underlying tray, whereby to permit such an overlying tray to rotate angularly above such underlying tray, at least the second pin receiving means including track means to accept the second pin means of such underlying tray slidably when so rotated angularly relative to such underlying tray, said track means continuing to and terminating in at least one open end at the outer side of said body.

5. The stacking tray as defined in claim 4, wherein said track means has detent means, directly beneath said pin means thereabove, to latch said tray in registration with such an underlying tray.

6. The stacking tray as defined in claim 4, wherein the length of said pin means and depth of said pin receiving means are so proportioned as to draw the sides of the tray against the adjacent sides of such overlying and underlying trays, and wherein said tray has imperforate inner and upper separator wall portions dividing the track means from the body container-like depressions, whereby when such trays are stacked in underlying-overlying relationship, the assembly thereof resists entry of water and has flotation characteristics.

* * * * *

UNITED STATES PATENT AND TRADEMARK OFFICE

CERTIFICATE OF CORRECTION

PATENT NO. : 4,155,477

DATED : May 22, 1979

INVENTOR(S) : Donald H. Fosher

It is certified that error appears in the above-identified patent and that said Letters Patent are hereby corrected as shown below:

In column 1, line 55, insert the word ---and--- between "pin" and "which".

In column 2, line 43, delete the numeral "2" and insert the numeral ---22---.

In Claim 4, line 6, delete "." and insert ---,---.

Signed and Sealed this

*Eleventh* Day of *September 1979*

[SEAL]

*Attest:*

*Attesting Officer*

LUTRELLE F. PARKER

*Acting Commissioner of Patents and Trademarks*